United States Patent [19]

Lemus

[11] 4,294,151

[45] Oct. 13, 1981

[54] ANTI-KICK BACK DEVICE

[76] Inventor: Julian Lemus, 5614 River Shore Dr., Tampa, Fla. 33603

[21] Appl. No.: 96,926

[22] Filed: Nov. 23, 1979

[51] Int. Cl.[3] ..... B27B 5/22

[52] U.S. Cl. ..... 83/477.2; 83/425; 83/437; 83/446; 83/478

[58] Field of Search ..... 83/102.1, 322, 420, 83/425, 437, 446, 447, 477.2, 719, 720, 478

[56] References Cited

U.S. PATENT DOCUMENTS

| | | | |
|---|---|---|---|
| 363,016 | 5/1887 | Stalter | 83/466 |
| 1,094,710 | 4/1914 | Flohr | 83/477.2 |
| 1,183,383 | 5/1916 | Jenkins | 83/477.2 |
| 1,735,240 | 11/1929 | Ennen | 83/447 X |
| 2,739,625 | 3/1956 | Peters | 83/425 |
| 3,101,104 | 8/1963 | Sullivan | 83/447 X |
| 3,491,807 | 1/1970 | Underwood | 83/446 X |
| 4,132,256 | 1/1979 | Jones | 83/446 X |

*Primary Examiner*—Frank T. Yost
*Assistant Examiner*—Robert P. Olszewski
*Attorney, Agent, or Firm*—Stein & Frijouf

[57] ABSTRACT

A typical bench saw, using a removable, adjustable position guide rail is shown in a typical environment for this invention. To prevent reverse travel of the workpiece after a cut has reached a point where it is not under full operator control, a blocking device is housed in an opening of the fence guide and is spring-loaded to project a flat abutment surface thereof from the normal guide surface of the fence. A workpiece moved along the fence will cam down the blocking device because the rear portion of the blocking device is a cam surface hinged on the upstream side of the workpiece path. A second blocking device is housed in an opening in the surface of the table traversing the normal work path of a workpiece, and is hinged and spring-loaded exactly as the blocking device of the fence guide. Either one of the two blocking devices may be used separately, but the uses compliment one another. In particular, when the guide fence is placed so close to the saw blade that the fence seats over the table blocking device and holds it permanently retracted, then the fence device continues to provide full protection. It is such narrow cutting that presents the most danger and therefore the blocking device of the guide, placed just prior to the saw blade, will permit a blocking action regardless of how thin a workpiece is being cut. This benefit of narrow cut protection is opposed to the limit placed by surface grip pawls as used in the prior art. The foregoing abstract is merely a resume of one general application, is not a complete discussion of all principles of operation or applications, and is not to be construed as a limitation on the scope of the claimed subject matter.

4 Claims, 12 Drawing Figures

FIG. 1
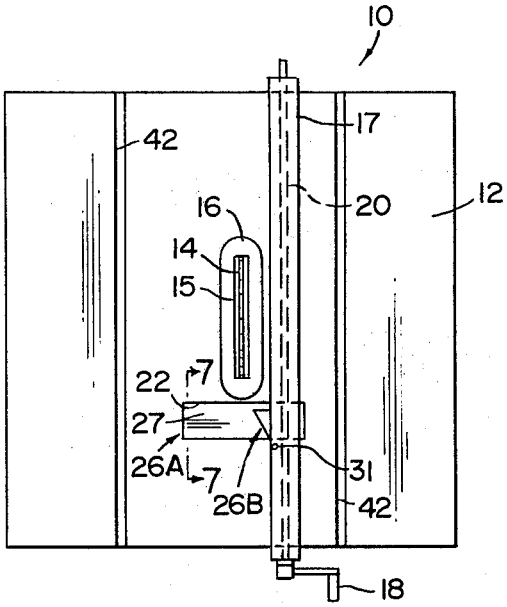
FIG. 2
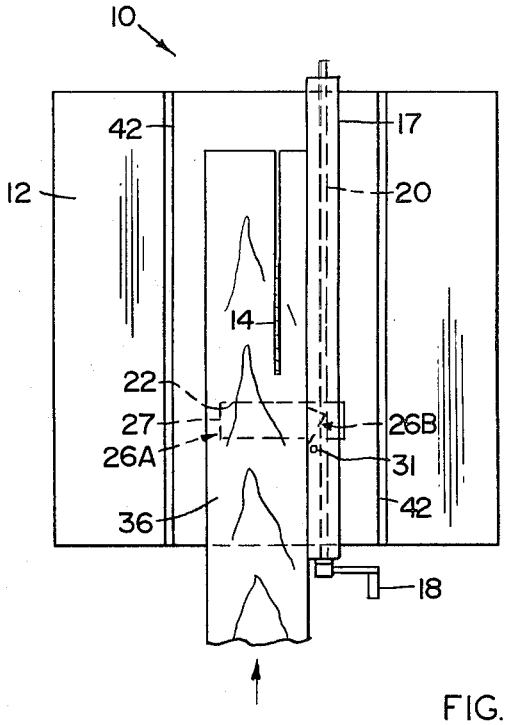
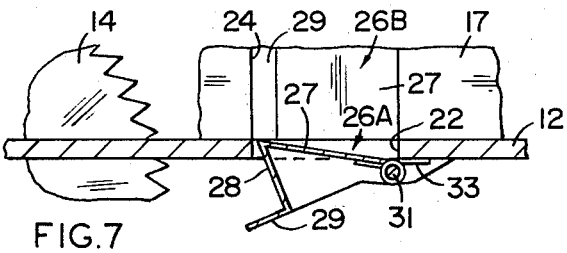
FIG. 7
FIG. 5
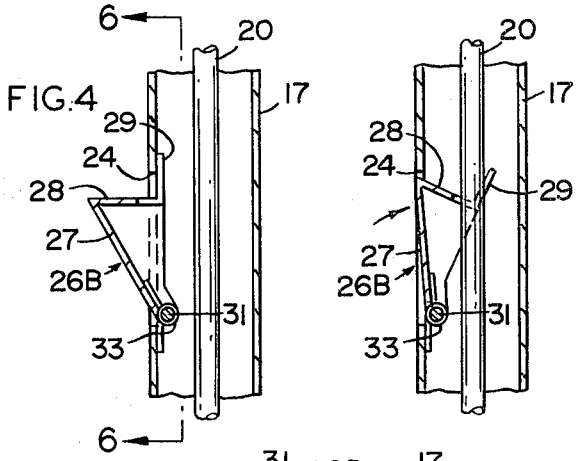
FIG. 4
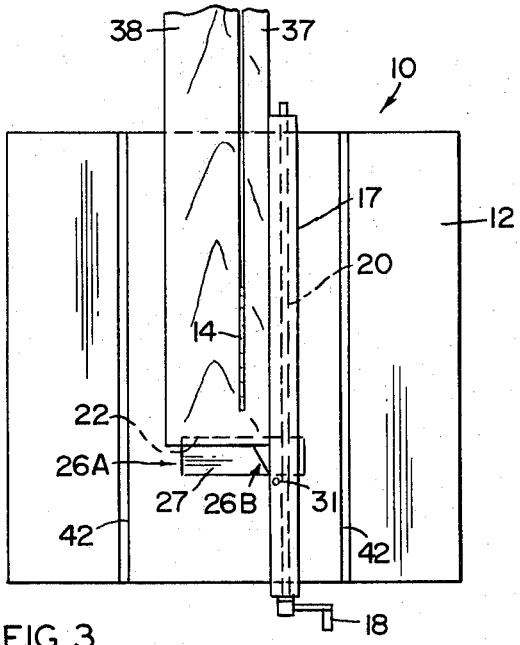
FIG. 3
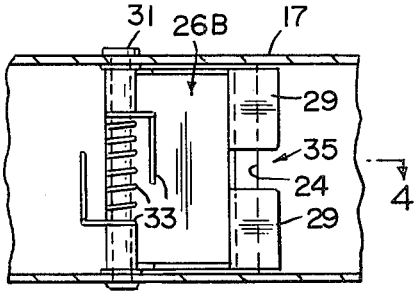
FIG. 6
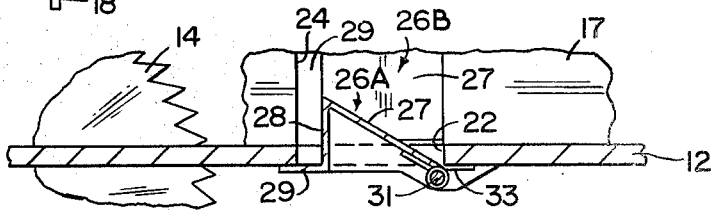
FIG. 8

FIG. 9
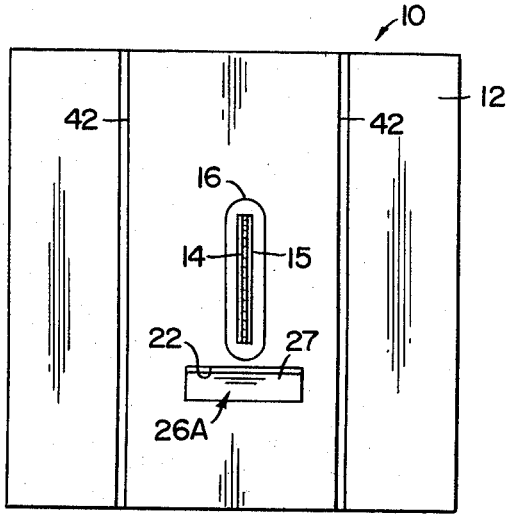
FIG. 10
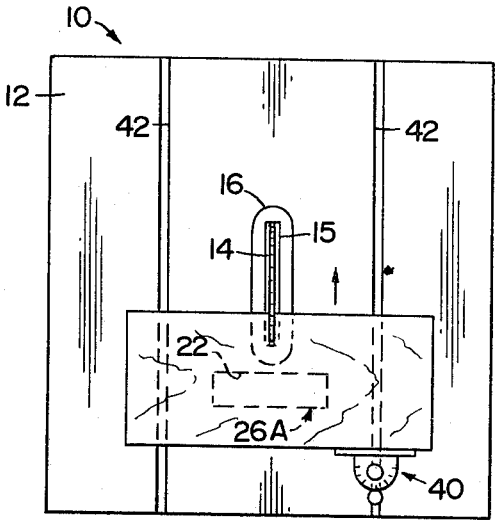
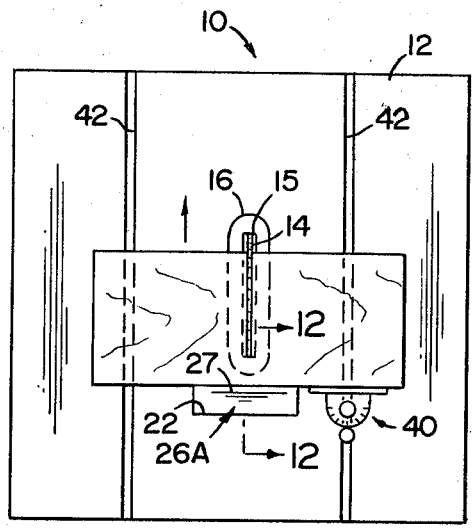
FIG. 11
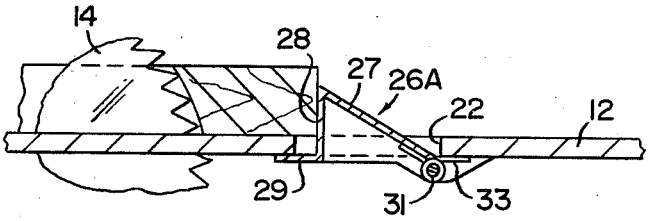
FIG. 12

ANTI-KICK BACK DEVICE

BACKGROUND OF THE INVENTION

1. Field of the Invention

This invention applies principally to table saw safety. More specifically to the concept of workpiece activated safety means to prevent reverse travel of a workpiece after a cut has reached a point where it is not under full operator control.

2. Description of the Prior Art

The available devices for prevention of kick back prior to this invention have been pawls which attach on the surface of the guide fence and drag along the workpiece surface. See U.S. Pat. No. 1,094,710. Another U.S. Pat. No. 1,183,383 has a strong resemblance to an anti-kick back device but is in fact a tool to aid the workman to make multiple cuts. Note the blocking surface in a post-cut position. Since this latter device was filed seven years after issue of the earlier patent, and has issued over a half century ago, it is evident that the modification of the latter device to serve the object of this invention was not suggested nor contemplated and not obvious in view of the pressing need. Sears & Roebuck "Power Tool Know-How" Catalog No. 9-2918, revised 1978, suggests only using anti-kick back pawls similar to that of U.S. Pat. No. 1,094,710 supra.

Therefore it is an object of this invention to provide an apparatus which overcomes the aforementioned inadequacies of the prior art devices and provides an improvement which is a significant improvement to the advancement of the table saw art.

Another object of this invention is to provide a means to block the reverse travel of a workpiece being processed through a cutting tool.

Another object of the invention is to provide a means to block the reverse travel of a workpiece being processed through a bench saw, which means will be operative for any width cut, even as thin as the saw will process.

A still further object of the invention is to provide an anti-kick back device which is activated by intrinsic structure apart from operator control.

Yet another object of the invention is to provide an anti-kick back set cooperatively preventing reverse travel of a workpiece being processed.

The object of the invention is to prevent reverse travel of a workpiece at a position in its travel just prior to or immediately after being fully severed.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

This invention provides an interference to reverse travel of a workpiece being shaped or cut as it is moved along a table relative to a cutting tool.

The principal use is with table saws. When a workpiece being cut binds with the blade, it will be driven in a reverse direction with considerable violence. This event is known in the trade as a "kick back". When cutting a very narrow workpiece, the workman will use a "push stick" to avoid getting his hand too close to the blade. Force applied by such stick, or even by hand, will often result in a skew force tending to bind the piece being cut, resulting in a violent reverse drive. Kick back is avoided by perfect true travel of the workpiece relative to the blade. Unfortunately, perfect alignment is not always achieved.

This invention provides a blocking member placed just prior to the entrance of the workpiece into the cutting action of the blade and is a recessed member urged to project from the recess, but forced into the recess by the presence of a workpiece. As the workpiece passes beyond the position of the anti-kick back blocking device, the blocking device, without assistance or control of the operator, projects from its recess and presents a block to the reverse travel of a workpiece in the event it should be driven in the reverse direction.

It is noteworthy that this invention cannot be deactivated by the operator, and therefore is beyond human error. It has been discovered that the blocking device must be placed in a position where it will become active before the work piece is completely severed from scrap.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a top plan view of a table saw equipped with the device of this invention located in both the table and rip fence;

FIG. 2 is a top plan view of a table saw with the device of this invention and with a workpiece in active cutting process;

FIG. 3 illustrates from a top plan view the operation of the table device inactivated and the anti-kick back device of the fence in operative position just prior to the severance of the cut from the scrap;

FIG. 4 is a fragmentary, enlarged, sectional plan view of the anti-kick back blocking means in a normal extended position;

FIG. 5 illustrates the retracted position of the blocking means;

FIG. 6 is a section along line 6—6 of FIG. 4;

FIG. 7 is a section along line 7—7 of FIG. 1.

FIG. 8 illustrates the condition wherein the fence is a sufficient distance from the table block that both are operative at the same time.

FIG. 9 is a plan view of a saw table equipped with only a table device made in accordance with this invention;

FIG. 10 illustrates a cut in progress;

FIG. 11 illustrates the operation of the table device to prevent reverse travel of a workpiece; and FIG. 12 is taken along line 12—12 of FIG. 11.

Similar reference characters refer to similar parts throughout the several views of the drawings.

DETAILED DESCRIPTION

The drawing illustrates the normal environment for the use of the present invention, this being a bench power saw 10. The bench 10 utilizes a planar work table 12, usually of heavy cast metal construction to provide a rigid workpiece surface. The power train is normally located below the table and powers a spindle mounted blade 14 in a position to project through a slot 15 in the work table. The slot 15 is generally considerably larger than necessary to admit the blade 14, in order to provide installation space, such as a place to extend a wrench to a tightening nut on the spindle. Therefore, a removable slot reducer cover 16 is generally placed in the slot over the blade after the blade is properly installed.

In FIGS. 1–8, a guide fence 17 is removably positioned on the table parallel to the blade 14 for establishing the width of a cut and to provide a stable guide surface.

The guide fence 17 is normally secured to the work table 12 by an internally operated clamping system. The illustrated embodiment shows a crank arm 18 for ease of illustration, although quite commonly the fence is equipped with a vertically operated cam lever. In any event, a rod 20 extends through the interior of the fence, which is a hollow box construction to interconnect clamping mechanisms operating on opposite ends of the fence. In this manner the fence can be released from the table and moved laterally to a proper parallel position with respect to the blade 14 and in a space relationship which will establish the width of the resultant workpiece 37 cut from base stock material 38.

In the trade, the piece selected to be cut is normally known as a "base piece". The reference character 36 indicates this base piece. The piece that is between the fence and the blade is normally considered the workpiece. Regardless of the size and quality of the material on the opposite side of the blade, it is considered to be the scrap. Hence, that nomenclature is employed here. The workpiece is indicated by reference character 37 and the scrap by the reference character 38.

Those who have operated a table saw, particularly in the smaller sizes used by home craftsmen, are quite aware of the danger and injury that can result from reverse drive, or kick back. The kick back is a result of the workpiece 37 being driven in a skew manner such that it binds between the fence and the blade and therefore receives a strong reverse drive. As long as the workpiece 37 is not completely severed from the base stock 38, the operator can prevent kick back and keep the workpiece 37 under control. In fact, it is seldom a problem until the workpiece is almost severed from the base stock. At this point of the operation, the operator will hold the workpiece on the side of the blade adjacent the fence 17 if the workpiece is adequately sized. However, very often the workpiece is the smaller of the two members and there is no way that the workman can hold the workpiece safely. Therefore the operator generally uses a push stick which is simply a piece of scrap wood, or perhaps a piece of scrap which has been cut with a notch and saved for the very purpose of pushing the workpiece near the blade with the hand of the operator at a safe distance away. At that time however, the danger of causing the skew force on the workpiece 37 is greatly enhanced due to the removal of the operator a distance from the workpiece and through a member which has no sense of feel directly with the workpiece. As the workpiece 37 is reduced in width, the reverse acceleration is increased since the same reverse force is applied to a smaller workpiece mass. Accordingly, kick back force is most severe when the workpiece is thin or sharp thus compounding the problem. Some in the prior art have attempted to provide anti-kick back devices. However, none of these devices were operable on a thin workpiece when the danger of binding and reverse drive danger is at its maximum. This invention provides a means to prevent the unintentional reverse drive of a workpiece as the cut reaches this near completion position.

This invention provides the blocking of the reverse drive through a structure which is not under the control of the workman and therefore cannot be deactivated. In FIG. 7, a recess 22 in the table 12 and in FIG. 4 a recess 24 in the fence 17 are located for the blocking device of this invention.

A block 26A in the table and a block 26B in the fence each has a cam back 27, an abutment surface 28, and a catch toe 29. A hinge pin 31 in either structure mounts the block 26 on the side of the recess 22 opposite the blade 14. A coil spring 33, shown best in FIG. 6, urges the block 26 to a position projecting from the opening with the catch toe 29 establishing the maximum distance of projection. The recesses 22 and 24 are sufficiently large to permit the cam surface 27 to be retracted entirely within the recess against the urging of the spring 33.

The block 26B in the fence 17 includes a slot 35 which receives clamp rod 20 when the block is moved into the retracted position as shown in FIG. 5.

FIGS. 9–12 illustrate the operation of the table mounted device alone, when the rip fence is removed. The block 26A extends across the work path perpendicular to the plane in which the saw blade lies, and a portion of the block 26A lies on each side of that plane. Therefore, if the guide fence shown in FIGS. 1–7 were placed close to the blade for the purpose of making a very thin workpiece cut, the fence will rest on the block 26A and prevent that block in the table from operating as an automatic blocking device. When the fence is removed, block 26A moves to the elevated position shown in FIG. 12, to prevent kick back as the material passes the blocking position shown in FIG. 12.

As seasoned workmen know, and as admonished by the Sears & Roebuck manual above, one should never attempt to rip freehand. It is practically impossible to guide a workpiece by hand for a straight cut, and an unstraight cut can result in kick back. Hence, when making a cut that cannot benefit by the stable influence of the rip fence, another guide device is employed. FIGS. 10 and 11 show a commonly used miter gauge 40 operating in one of the two table grooves 42. The miter gauge may be used in either table groove. If using the left side groove, hold the miter gauge handle with the right hand and use the left hand to hold the workpiece.

Reverse hand positions to use the miter gauge on the right side groove. The hands must always be kept on the same side of the saw blade and never on opposite sides because doing so could bind the blade and cause a kick back. Nevertheless, binding and kick back can and does occur even with the most careful workman. Therefore, the block 26A is restricted in length sufficiently to allow the miter gauge 40 to move forward in the groove 42 without depressing the block into the table as was done by the guide fence. The guide fence is positionable to any lateral space from the blade, but the miter gauge operates only in either of the two established grooves.

There are many auxiliary devices such as auxiliary fences and additional clamps that workmen do use in making special cuts, but this invention will require that such devices be carefully positioned so as not to inadvertently depress either of the blocks 26 at the critical time when kick back could occur. This time is illustrated in FIG. 11 wherein the miter gauge has moved the workpiece in a crosscut to a position where block 26A has been able to return under the urge of spring 33 to its blocking position. Thereafter, if the workpiece does bind for any reason, it is prevented from the disasterous return movement by the provision of block 26A. This elevational position is shown best in FIG. 12 of the drawings.

This invention is successful because it is a positive block in the workpath. It does not depend upon any surface grip device which can slip. Further, it cannot be decomissioned by the operator because it is not under operator control. The location of the device is the key to success in that it becomes active while the workpiece and scrap are united and under full operator control, just prior to severance of the parts from one another and immediately afterwards and immediately afterwards.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, the invention claimed is:

1. In a bench power saw having a work table with a rotary cutting blade projecting above the plane of the table, and a guide fence extending vertically from the table and being adjustably positionable on the table parallel to said blade for establishing the width of a cut, the table and fence establishing a workpiece path, the provision of a means for preventing the unintentional reverse drive of a workpiece as the cut is completed, comprising:

a surface of the guide fence having a recess opening prior to the blade position and adjacent thereto;

a blocking member housed in said opening;

said blocking member located in said workpiece path and having a cam surface on the side thereof opposite the blade;

means for mounting said blocking member for movement about a substantially vertical axis between a fully retracted position within said opening and a projected position wherein said cam surface extends from said opening in an outwardly angular direction towards said blade; and means for urging said blocking means to the projected position, whereby a workpiece directed toward the blade in the workpiece path will cam down the blocking member and proceed to the cutting position, and after the workpiece has passed over the blocking member, but before being fully severed, the blocking member will return to the projected position to prevent reverse travel of the workpiece.

2. In a bench saw combination as defined in claim 1, said recess opening being in the vertical side surface of the guide fence and located adjacent the upstream side of the blade.

3. In a bench saw combination as defined in claim 1, wherein the blocking member is pivoted at the side of said opening opposite said blade for a swinging movement between a position wherein the blocking member is flush with said table and an active position projecting at an angle from the back of the opening toward the saw blade.

4. In a bench saw combination as defined in claim 1, including a second recess opening in the work table extending laterally across said workpiece path with portions thereof lying on both sides of a plane incorporating the plane of the cutting blade;

a second blocking member housed in said second opening;

means for mounting said second blocking member for movement between a fully retracted position within said second opening and a projected position wherein said blocking member extends from said second opening in an angular direction toward said blade other than when said guide fence is placed close to the blade over the second opening; and means for urging said second blocking means to the projected position enabling said second blocking member to prevent reverse travel of the workpiece.

* * * * *